US007621208B2

(12) United States Patent
Huffman

(10) Patent No.: US 7,621,208 B2
(45) **Date of Patent: *Nov. 24, 2009**

(54) REDUCED ENERGY TRAINING CARTRIDGE FOR SELF-LOADING FIREARMS

(75) Inventor: Rick Huffman, Redwood Valley, CA (US)

(73) Assignee: Federal Cartridge Company, Anoka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/616,843

(22) Filed: Dec. 27, 2006

(65) Prior Publication Data

US 2007/0199470 A1 Aug. 30, 2007

Related U.S. Application Data

(63) Continuation of application No. 10/799,898, filed on Mar. 12, 2004, now Pat. No. 7,225,741.

(60) Provisional application No. 60/539,022, filed on Jan. 22, 2004.

(51) Int. Cl.
*B64D 1/04* (2006.01)

(52) U.S. Cl. ..... 89/1.13; 102/434; 102/433; 102/444; 102/446; 102/447; 102/464; 102/469

(58) Field of Classification Search ..... 89/1.13; 102/434, 433, 444, 446, 447, 464, 469
See application file for complete search history.

(56) References Cited

U.S. PATENT DOCUMENTS 3,144,827 A 8/1964 Boutwell
3,952,662 A 4/1976 Greenlees (Continued)

FOREIGN PATENT DOCUMENTS

WO WO 98/41809 9/1998

(Continued)

OTHER PUBLICATIONS

"Notification of Transmittal of The International Search Report and the Written Opinion of the International Searching Authority, or the Declaration" for PCT Application No. PCT/US2004/007840, dated Jun. 28, 2006, 18 pages.

*Primary Examiner*—Michelle Clement
(74) *Attorney, Agent, or Firm*—Patterson, Thuente, Skaar & Christensen, P.A.

(57) ABSTRACT

A two piece, two-stage, rechargeable, reusable, reduced-energy mechanically operating cartridge is provided for launching a bullet of various compositions from a dedicated or modified firearm. The cartridge unit is comprised of a primary case, a piston sleeve, a propellant unit, and a bullet choice of a solid light weight material for inanimate-target applications or a "marking" version for non-lethal live-target training applications. Cartridge includes a piston sleeve and a primary case coupled together via a channel and cog locking/traveling/unlocking system. The primary case includes a substantially non-deformable jacket defining a cavity to receive a propellant unit or propellant connection and provides the channels to receive piston sleeves cogs for a locking/traveling/unlocking feature. The piston sleeve includes a substantially non-deformable jacket defining a cavity to receive configured bullet. The primary case also includes a substantially non-deformable jacket for being axially coupled with the piston sleeve, and for coupling with a propellant mechanism. Upon activation of the mechanically operating cartridge within the chamber of the firearm during stage 2, the piston sleeve and primary case telescope apart from a compressed, static, stage 1 position forcing the firearm's slide or bolt to the rear, a mechanical operation opposed to a conventional cartridge with gas blow back operations. Spent cartridge is reused by manually separating piston sleeve from primary case as to remove spent propellant unit with removal tool, recharged with new propellant unit reloaded with choice of bullet composition and placed into magazine or similar for firearm loading.

32 Claims, 12 Drawing Sheets

U.S. PATENT DOCUMENTS 3,982,489 A 9/1976 Flatau et al.
4,262,597 A 4/1981 Olson
4,270,293 A 6/1981 Plumer et al.
4,565,131 A 1/1986 Buchner
4,899,660 A 2/1990 Brighton
5,016,536 A 5/1991 Brighton
5,035,183 A 7/1991 Luxton
5,121,692 A 6/1992 DiCarlo
5,219,316 A 6/1993 Huffman
5,221,809 A 6/1993 Cuadros
5,239,928 A 8/1993 Ricci
5,359,937 A 11/1994 Dittrich
5,492,063 A 2/1996 Dittrich
5,520,019 A 5/1996 Schuetz
5,652,407 A 7/1997 Carbone
5,740,629 A 4/1998 Schuetz et al.
5,791,327 A 8/1998 Riggs et al.
5,962,806 A 10/1999 Coakley et al.
5,965,839 A 10/1999 Vasel et al.
5,974,942 A 11/1999 Dionne
5,983,548 A 11/1999 Ludaescher
5,983,773 A 11/1999 Dionne
6,095,051 A 8/2000 Saxby
6,178,889 B1 * 1/2001 Dindl ..... 102/447
6,209,461 B1 4/2001 Riffet et al.
6,230,630 B1 5/2001 Gibson et al.
6,250,226 B1 6/2001 Leichter et al.
6,253,682 B1 * 7/2001 Saxby ..... 102/444
6,276,252 B1 8/2001 Dionne
6,295,933 B1 10/2001 Dubocage et al.
6,302,028 B1 10/2001 Guillot-Ulmann et al.
6,324,984 B1 * 12/2001 Dindl ..... 102/447
6,357,331 B1 3/2002 Dionne
6,374,741 B1 4/2002 Stanley et al.
6,393,992 B1 5/2002 Vasel et al.
6,415,718 B1 7/2002 Saxby
6,422,149 B1 * 7/2002 Saxby ..... 102/446
6,427,600 B2 * 8/2002 Saxby ..... 102/444
6,439,123 B1 8/2002 Dionne et al.
6,442,882 B1 9/2002 Dionne
6,543,365 B1 4/2003 Vasel et al.
6,546,874 B2 4/2003 Vasel et al.
6,553,913 B1 4/2003 Wardlaw
6,564,719 B2 5/2003 Saxby
6,575,098 B2 6/2003 Hsiung
6,604,946 B2 8/2003 Oakes
6,615,739 B2 9/2003 Gibson et al.
6,625,916 B1 9/2003 Dionne
6,658,779 B2 12/2003 Bauer et al.
6,672,218 B2 1/2004 Oechslin et al.
6,845,716 B2 1/2005 Husseini et al.
7,021,219 B1 * 4/2006 Dindl ..... 102/447
2003/0145745 A1 8/2003 Saxby
2007/0272111 A1 * 11/2007 Saxby ..... 102/444

FOREIGN PATENT DOCUMENTS

WO WO 03/033987 A1 4/2003
WO WO 03/102492 A1 11/2003
WO WO 2005/076787 A2 8/2005
WO WO 2005/076787 A3 8/2006

* cited by examiner

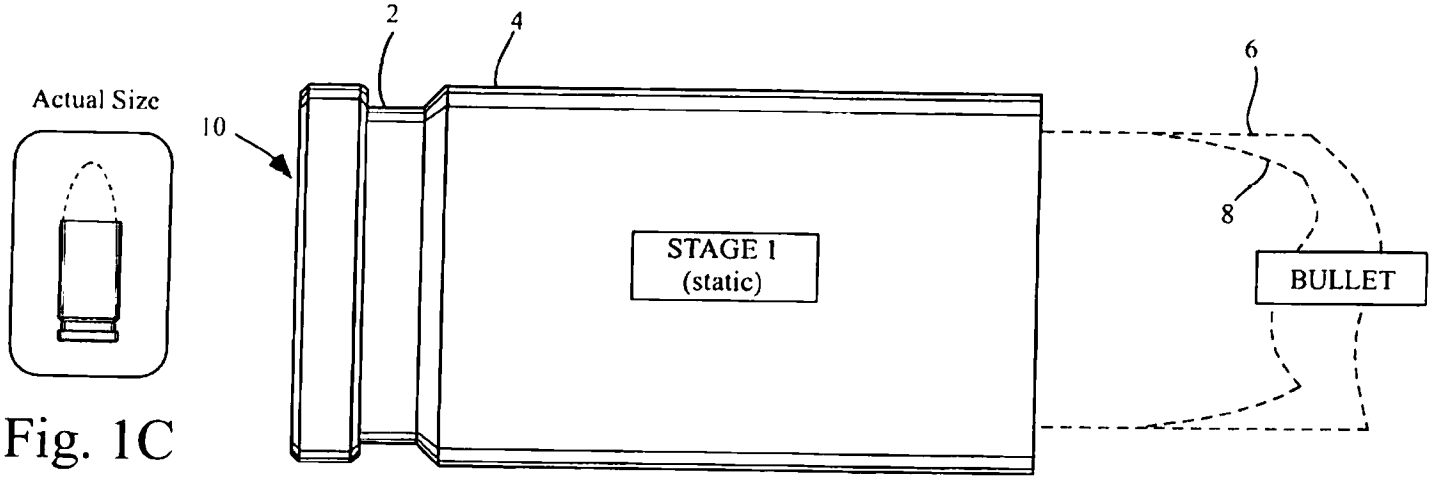
Fig. 1A
Fig. 1C
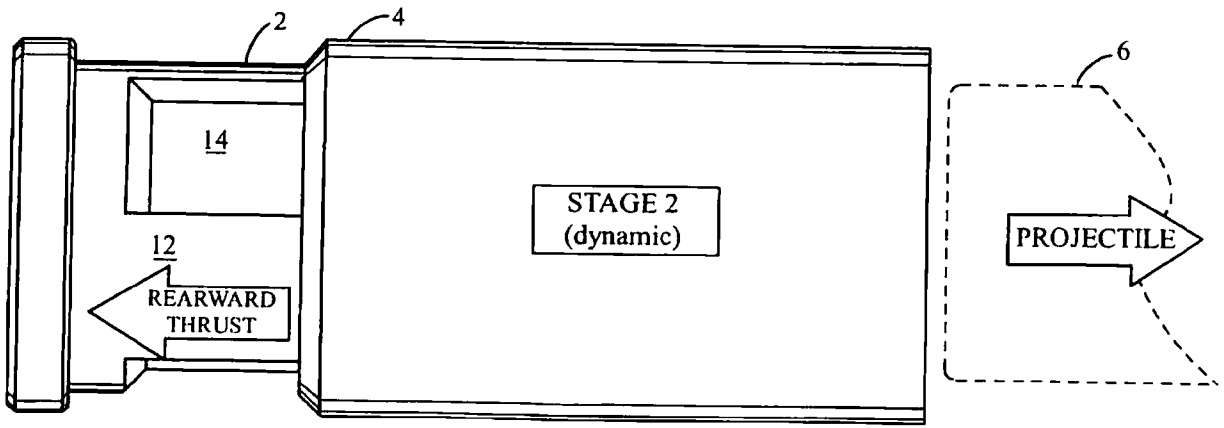
Fig. 1B

REDUCED ENERGY TRAINING CARTRIDGE FOR SELF-LOADING FIREARMS

CROSS-REFERENCE TO RELATED APPLICATIONS

This application is a Continuation of U.S. patent application Ser. No. 10/799,898, filed Mar. 12, 2004, now U.S. Pat. No. 7,225,741, issued Jun. 5, 2007, which claims the benefit of priority to U.S. provisional patent application No. 60/539,022, filed Jan. 22, 2004 by inventor Rick Huffman, which is hereby incorporated by reference.

BACKGROUND OF THE INVENTION

1. Field of the Invention

The invention relates to reality based training (common to law enforcement and military operations) utilizing firearms, weapons, equipment, supplies and/or accessories, dedicated or modified of non-lethal status and particularly to a two piece, two stage, rechargeable, reduced energy mechanically operating cartridge of reusable components.

2. Description of Related Art

In the past, non-lethal training ammunition (NLTA) of a pyrotechnic composition has utilized rounds that are limited to single use then discarded not to be reused again. This design prevents recharging of cartridge (reloading) due to restrict energy characteristics preventing 'overcharging' allowing a projectile to travel at an unsafe velocity.

Such companies as Simunition, Ltd, of Quebec, Canada, for example, use pyrotechnic cartridges with metal shell casings and polymer extension or sabots. The polymer material permits the base shell casing to press-fit into a tight coupling with the cartridge. When detonated, the energy of the propellant material causes the casing base to release away from the non-lethal bullet-containing sabot which is substantially fixed in place within the chamber of the non-lethal firearm being used. The casing base drives rearward forcing the firearm's bolt/slide to the rear. This feature is known as the "mechanical extension or telescoping" of the two pieces forming the non-lethal ammunition cartridge during firing.

A special shoulder within the non-lethal firearms barrel chamber maintain contact with the sabot rim forcing the primer case base to extend rearward. Ultimately, the bullet is propelled owing to the release of gas pressure through a flash hole. The sabot and casing base extend but do not detach. Since the casing base and sabot cannot traditionally be separated, "recharging or reloading" is prevented or discouraged. It is desired to have a training cartridge for use with firearms training applications to utilize NLTA that may be recharged (reloaded) with a replaceable self-contained propellant unit, and fitted with various bullet configurations and then reused.

BRIEF SUMMARY OF THE INVENTION

In view of the above, a two piece, two-stage, rechargeable, reusable, reduced-energy mechanically operating cartridge is provided for propelling a bullet of non-lethal composition from a dedicated or modified (rendered non-lethal status) firearm. The cartridge unit is comprised of a primary case, a piston sleeve, a propellant unit, and a bullet choice of a solid light weight material for inanimate-target applications or a "marking" version for non-lethal live-target applications. The piston sleeve includes a substantially non-deformable jacket defining a bullet housing cavity at a first longitudinal end for coupling the bullet of non-lethal composition therein. The other end couples with the primary case. The primary case also includes a substantially non-deformable jacket for being axially coupled with the piston sleeve. The primary case also defines a cavity for receiving and retaining the propellant unit, a self contained unit consisting of a pyrotechnic material, or for containing pressurized gas or other propellant material. Upon activation, or cartridge discharging, the piston sleeve and primary case "mechanically extend or telescope" (dynamic condition) out from a compressed position (static condition), and thrust the base of the primary case away from the piston sleeve. The piston sleeve and primary case, having not substantially deformed preceding the mechanical operation are manually detached, spent propellant unit removed then replaced with a fresh one (cartridge recharged), the bullet is replaced, and the cartridge is ready for reuse.

According to another aspect, a two-piece, two-stage, rechargeable, reusable, mechanically operating cartridge for propelling a bullet of non-lethal composition from a dedicated or modified (rendered non-lethal status) firearm is provided including a primary case, a piston sleeve, a propellant unit, and a bullet choice of a solid light weight material for inanimate-target applications or a "marking" version for live-target applications. The piston sleeve includes a jacket defining a bullet housing cavity, or "mouth" at a first longitudinal end for coupling the bullet therein. The second end of the sleeve, or "throat" couples with the primary case and includes one or more partially annular ridge portions, or "cogs". The primary case also includes a jacket for being axially coupled with the second end of the piston sleeve, and including one or more complementary cogs and/or channels to the cogs of the piston sleeve. The primary case also defines a cavity for coupling with a propellant unit of pyrotechnic compound or for containing pressurized gas or other propellant material. Upon axial coupling and at least partial compression, the primary case and piston sleeve become relatively rotationally movable (cogs traveling in channels) to angularly overlap their respective ridge portions. The angular overlap is present when the piston sleeve and primary case are set into a compressed position. Upon cartridge discharging, when the primary case and piston sleeve are thrust apart in the dynamic condition, the piston sleeve and primary case generally remain coupled within the chamber of the firearm's barrel, although in one aspect of the invention, the cogs may be shearable such as to allow separation to reduce energy.

The cogs of the piston sleeve may include two or three or more spaced apart cogs or cog portions. The piston sleeve may further include groove portions, or "channels" between the cogs for mating with the complementary cogs of the primary case. These channels may slidably couple with the complementary cogs, corresponding to cog travel within channels.

According to a further aspect, the firearm includes an annular step between the chamber and the barrel. Upon cartridge discharging shoulders of the piston sleeve remain in firm contact with the annular step within the barrel's chamber, while the primary case and sleeve are thrust away from the compressed, static position to a telescoped position. The shoulder of the piston sleeve contact the annular step of the firearm's chamber preventing the sleeve from advancing further within the barrel, such that the piston sleeve and primary case remain coupled within the chamber of the firearm.

An advantageous cartridge may include any of the above-recited aspects alone or in combination with other aspects. Ultimately upon cartridge discharging, the bullet is propelled down the barrel of the non-lethal status firearm due to propellant pressure releasing through a "regulator" hole that preferably has a selected size or open/close devise for regulating the velocity of the projectile. Moreover, the piston sleeve preferably defines a second cavity at an opposite longitudinal end, i.e., from the end that couples with the primary case, for fitting the bullet therein. The bullet may be configured such that more than half of the length of the bullet which is exposed outside the mouth of the piston sleeve when loaded includes a substantially right cylindrical shape. The mouth of the piston sleeve and the bullet may couple in part due to pressure fittings protruding inwardly from the sleeve, or outwardly from the projectile, or both. The propellant unit cavity and propellant unit may couple in part due to pressure fitting protruding inwardly from the primary case, or outwardly from propellant unit, or both.

A method of preparing a two-piece, two stage, rechargeable, reusable, mechanically operating cartridge including a piston sleeve, a primary case, a propellant unit, and bullet is also provided. A bullet of non-lethal composition is loaded into the mouth defined within the piston sleeve. A propellant unit is loaded into a cavity defined within the primary case or a propellant mechanism is coupled with the cavity. The piston sleeve is axially coupled with the primary case including an initial relative axial displacement of the sleeve and base to bring them together. Cog portions, or partial annular protrusions, of the piston sleeve are coupled with annular channels of the primary base during the initial axial displacement. The piston sleeve and primary case are relatively rotationally displaced after the initial axial displacement such as to prevent direct axial separation. Partially annular channels extend to angularly overlap cogs portions of each of the base and sleeve such that cog portions of the piston sleeve and primary case are angularly overlapped after the relative rotational displacement.

In accordance with another aspect, a method is provided for preparing a two-piece, two stage, rechargeable, reusable, mechanically operating cartridge including a piston sleeve, primary case, propellant unit, and bullet. The bullet of non-lethal composition is loaded into the mouth defined within the piston sleeve. A propellant unit is loaded into a cavity defined within the primary case or another propellant mechanism is coupled with the cavity. The primary base and the piston sleeve are coupled together to form a reduced energy mechanically operating cartridge. The primary base and piston sleeve may be decoupled after cartridge discharging and ejection from the chamber of the firearm. The bullet loading and propellant unit charging or other propellant mechanism coupling, respectively, may be repeated with another bullet configuration and another propellant unit or other propellant mechanism. The coupling may be repeated for reuse of the piston sleeve and primary case in a same cartridge together or in different cartridges.

The methods may further include reloading another bullet into the mouth defined within the piston sleeve for reuse, and/or recharging with another propellant unit into the cavity defined within the primary case or coupling with further propellant mechanism for reuse. The method may include repeating the bullet loading of the piston sleeve then recharging the primary cartridge with a propellant unit or coupling with another propellant mechanism, and repeating the coupling and rotating steps for reuse of the primary case and piston sleeve in a same mechanically operating cartridge together or in different cartridges. The piston sleeve and primary case of the two-piece cartridge of the reuse step may be reused, respectively, with a different reusable primary base and/or a different reusable piston sleeve.

The methods may include chambering the mechanically operating cartridge into the dedicated or modified firearm (rendered non-lethal status). The cartridge prior to mechanical activation is considered to be in stage one (static condition). Upon activation, or cartridge discharge, the primary case and piston sleeve preferably "mechanically extend or telescope" considered the second stage (dynamic condition). Ultimately in the second stage, the bullet is propelled down the barrel of the dedicated or modified (non-lethal status) firearm due to propellant pressure releasing through a flash hole regulator that mandates a selected size for regulating the velocity of the projectile. The primary case and the piston sleeve may be configured to be relatively rotationally movable to angularly overlap respective ridge portions. The angular overlap may be present when the piston sleeve and primary case are set into a compressed position (static condition), such that upon cartridge discharging, when the piston sleeve and primary case mechanically extend, the piston sleeve and primary case remain coupled within the chamber of the firearm. As a safety concern piston sleeve cogs are designed to "shear off" if propellant unit or propellant form is manipulated creating "overcharging" of propellant, as such cogs will shear off causing cartridge to separate entirely expelling excessive propellant thus preventing unsafe projectile velocity The firearm may include an annular step between the chamber and the barrel, such that upon firing when shoulder of the piston sleeve are firmly contacting the annular step, the primary case and piston sleeve are telescoped out from a compressed, static position to a telescoped position. The piston sleeve remains in contact with the annular step of the firearm preventing the sleeve from advancing further within the chamber of the barrel. The method may include coupling an annular O-ring protrusion, in addition to the coupling of the cogs and channels, within the throat of the piston sleeve coupled with the primary case stabilize the coupling of the charged mechanically operating cartridge when the two-piece cartridge is in a static position.

BRIEF DESCRIPTION OF THE SEVERAL VIEWS OF THE DRAWINGS

FIG. 1*a* illustrates a two-piece, two stage, reduced energy mechanically operating cartridge in a stage 1 (static, or compressed) position in accordance with a preferred embodiment.

FIG. 1*b* illustrates the two-piece, two stage reduced energy mechanically operating cartridge telescoped from the static, stage 1 or compressed position of FIG. 1*a*, such as would occur upon discharging according to stage 2 (dynamic operation), in accordance with a preferred embodiment.

FIG. 1*c* illustrates an actual size of the cartridge of FIG. 1*a* in the stage 1 (static) position.

FIGS. 4*a*-4*f* illustrating an exploded view of components.

FIG. 4*a* illustrates a propellant unit in accordance with a preferred embodiment.

FIG. 4*b* illustrates a snap ring in accordance with a preferred embodiment.

FIG. 4*c* illustrates a primary case in accordance with a preferred embodiment.

FIG. 4*d* illustrates an O-ring that coupled to the port end of the primary case.

FIG. 4*e* illustrates a bullet-containing sleeve or piston sleeve in accordance with a preferred embodiment.

FIG. 4*f* illustrates a bullet in accordance with a preferred embodiment.

FIG. 4*g* illustrates a cross-sectional view of a preferred propellant unit.

FIG. 4*h* illustrates the primary case with O-ring coupled at the port end.

FIG. 4*i* illustrates a view through the outer casing of the piston sleeve revealing the inner structure in accordance with a preferred embodiment.

FIG. 7*a* illustrates coupling of components in an exploded view of the two-stage cartridge of the preferred embodiment.

FIG. 7*b* illustrates the cartridge in static condition (stage 1).

FIG. 7*c* illustrates the cartridge in dynamic condition (stage 2).

FIG. 7*d* illustrates the uncoupling of the piston sleeve from the primary case.

FIG. 7*e* illustrates removal of the spent propellant unit from the primary case.

FIG. 7*f* illustrates the recharging, recoupling and reloading of the cartridge.

FIG. 7*g* illustrates the recharged, recoupling and reloaded cartridge of FIG. 7*f* in reusable, static condition (stage 1).

FIG. 8*a* illustrates a chambered cartridge in stage 1 (static) condition.

FIG. 8*b* illustrates extraction of the cartridge in stage 2 (dynamic) condition.

FIG. 8*c* illustrates ejection of the cartridge after discharge.

DETAILED DESCRIPTION OF THE INVENTION

Figure 1D:
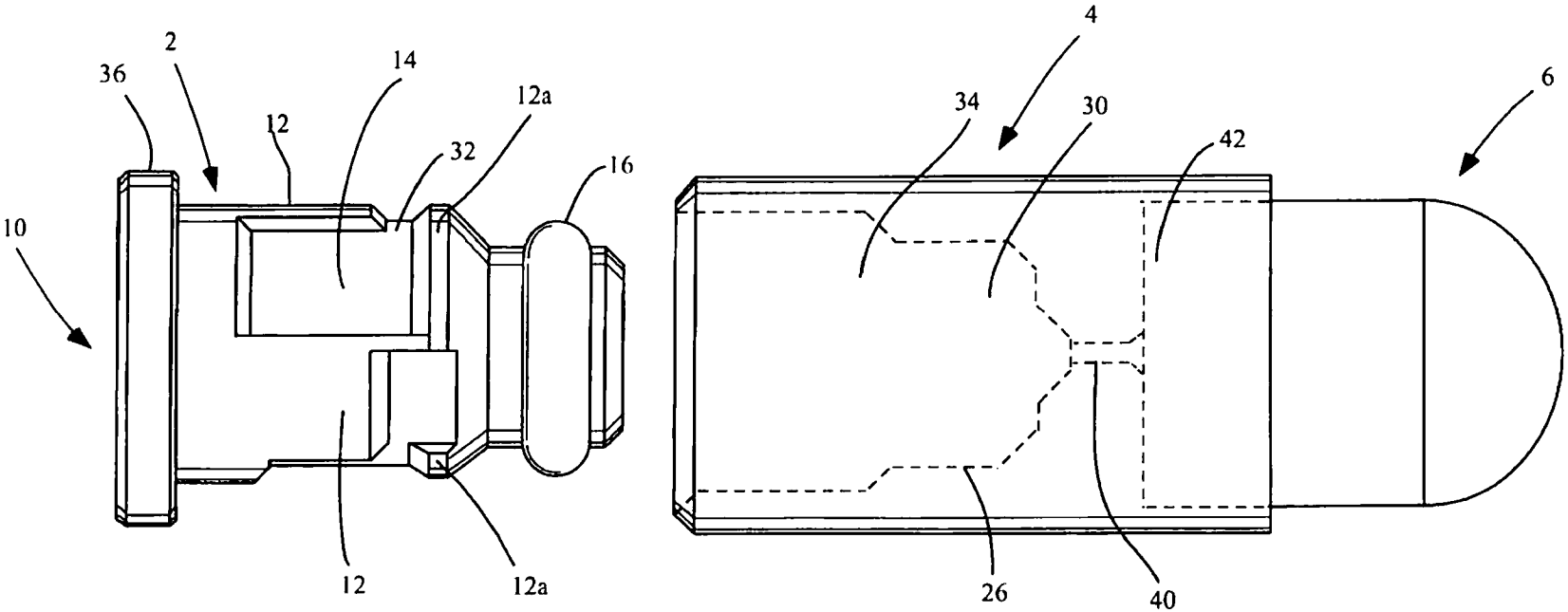
FIG. 1*d* illustrates how the two pieces of the cartridge of FIGS. 1*a*-1*c* preferably couple together.

FIG. 1*a* illustrates a two-piece, two stage reusable non-lethal, sub-lethal or lethal, mechanically operating cartridge in a fully compressed or "static" position in accordance with a preferred embodiment. The two-piece cartridge includes a primary case 2 and a piston sleeve 4 which contains a projectile 6,8. Note that the projectile 6,8 may include any of a variety of projectile shapes, weights and sizes and preferably comprises a non-lethal composition. The projectile 6,8 is preferably formed of polyethylene or a similarly plyable plastic, but other polymers or rubber or other materials may be used as understood by those skilled in the art. The projectile 6,8 is also preferably formed of two or more components that fit together in a substantially sealed assembly and having a cavity filled with a marking material which may be a thick paste such as liquid soap or glycerin, with tempora added for color. The terms "projectile" and "bullet" are generally used interchangeably herein, although as understood by those skilled in the art, a bullet may be housed within the piston sleeve 4 in static condition and become a projectile when launched.

As shown, the piston sleeve 4 or bullet-containing sleeve 4 couples over the primary case 2, as preferred. The primary case 2 will be referred to as a primer base when such is used with a primer cartridge of detonatable or explosive material as is used in the preferred embodiment. That is, the preferred cartridge is configured and contemplated to be coupled with such a primer cartridge (not shown in FIG. 1*a*), although a primary case 2 in accordance with alternative embodiments may use the same or differently-configured cavity 10 for coupling with a propellant mechanism such as a pressurized gas or another such mechanism known to those skilled in the art. Further, the primary case 2 could be configured to be coupled over the piston sleeve 4, or the coupling could be interlocking. A substantial longitudinal portion of the primary case 2 overlaps with that of the piston sleeve 4 when the two pieces 2,4 are relatively disposed in the static position. The primary case 2 and piston sleeve 4 are preferably formed from brass or stainless steel, and alternatively copper or another durable metal or other material that does not substantially deform during firing, so that the primary case 2 and sleeve 4 may be respectively recharged and reloaded for reuse.

A projectile 6 and a projectile 8, each of non-lethal composition, are outlined in FIG. 1*a* as being alternative bullet-types that may be loaded into the piston sleeve 4. The portion of the projectile 6 or bullet 6 or projectile 8 or bullet 8 that is not shown in FIG. 1*a* is preferably substantially cylindrical and coupled into a correspondingly cylindrical cavity of the piston or bullet sleeve 4. A difference between the projectile 6 and the projectile 8 is that the projectile 6 remains substantially cylindrical for more than half of its exposed length when loaded into the sleeve 4, and more particularly, for about two-thirds of its exposed length. The projectile 8, on the other hand, departs from cylindrical before reaching half of its exposed length, and more particularly, at about one-third of its exposed length. The shape of projectile 8 is advantageous in that its less pointed shape facilitates enhanced dispersion upon impact. The projectile 8 advantageously may also include etchings, scores or slits to facilitate this dispersing upon impact with a target, and dispersion of marking material if loaded within the projectile 8 or if the projectile may be substantially composed thereof. Where each of the projectiles 6,8 depart from cylindrical, they round at the leading end of each projectile 6,8. The preferred projectile 6 is formed of any of a variety of polymeric materials as understood by those skilled in the art.

FIG. 1*b* illustrates a two-piece, two stage reusable, reduced-energy, non-lethal, sub-lethal or lethal, mechanically-operating cartridge telescoped from the stage 1, static position of FIG. 1*a*, such as would occur upon firing in the stage 2, dynamic condition, in accordance with a preferred embodiment. The sleeve 4 remains in place having a shoulder that contacts a shoulder of a non-lethal modified or dedicated firearm, while the primary case 2 moved or thrust to the left, as illustrated at FIG. 1*b* or to the rear of the chamber or barrel of the firearm. FIG. 1*b* illustrates the telescoping feature of the cartridge upon firing and its enhanced longitudinal or axial extent may be compared with its longitudinal or axial extent when in the static position illustrated at FIG. 1*a*. This relative axial displacement is referred to as telescoping, and it occurs when the primer, pyrotechnic, or other propellant mechanism that is coupled with the primary case cavity 10 is exploded or detonated, or the cavity 10 is otherwise rapidly pressurized, providing energy to thrust the primary case 2 and piston sleeve 4 apart to a combined axially extended position in dynamic condition of stage 2 illustrated at FIG. 1*b* from the static position of stage 1 illustrated at FIG. 1*a*.

Figures 4A, 4B, 4C, 4D, 4E, 4F:
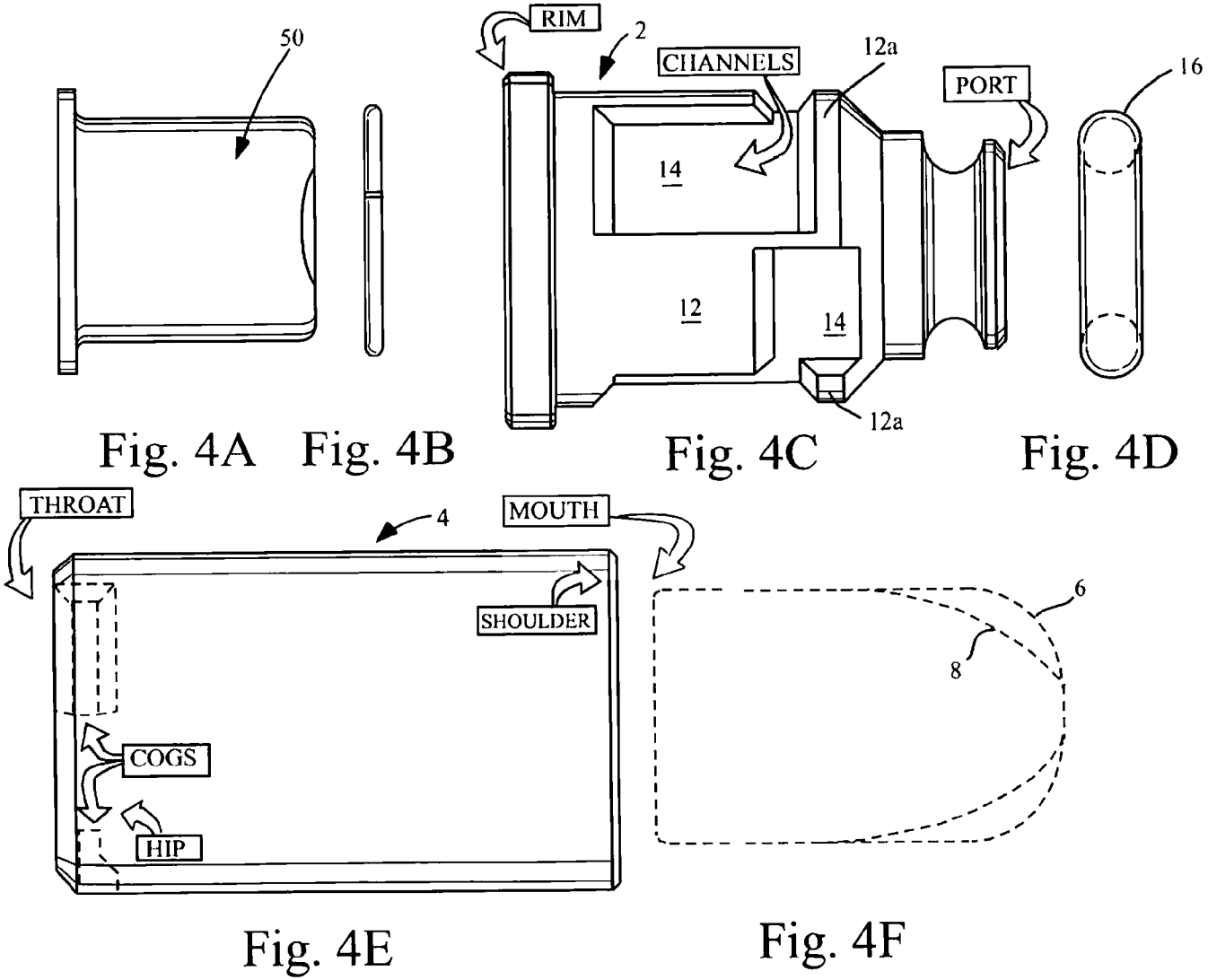
FIGS. 4*a*-4*i* illustrate different components of a two-stage, reduced energy cartridge in accordance with a preferred embodiment.

At one end of the primary case 2, a primary case cavity 10 is defined by a rim and includes an installed snap ring, which is shown in more detail in FIG. 4*b*. The cavity 10 extends into the case 2 for insertion of the primer cartridge (not shown, but see FIG. 4*a*) or for coupling with a pressurized gas source, for charging the two-piece cartridge. The cavity 10 may be further or alternatively configured for coupling with another propellant mechanism such as a pressurized gas or other fluid container or a port extending therefrom.

The preferred primer cartridge includes explosive material which detonates to propel the primary case 2 rearward from the bullet sleeve or piston sleeve 4, as illustrated at FIG. 1*b*, such that the case 2 and sleeve 4 telescope apart from a static position. The propellant pressure also releases through a firing hole regulator 40 (see FIG. 1*d*) having a size selected to regulate the velocity of the projectile, i.e., to release the projectile 6,8 down the barrel of a non-lethal dedicated or modified firearm. The combination of the rearward thrust of the primary case 2 and the regulation by the regulator hole 40 serve to reduce and/or regulate the energy of the propelled projectile. As will be described in more detail below when the cogs and channels of the internal coupling structures of the primary case 2 and piston sleeve 4 are discussed, another energy reduction mechanism preferably becomes involved if propellant is manipulated creating an overcharging. In that case, piston sleeve 4 will separate from primary case via a sheering action of cogs releasing excessive energy preventing projectile of traveling at excessive velocity.

Some of the exterior structure of the primary case 2 are shown in FIG. 1*b* as a result of the case 2 having telescoped or moved away from the sleeve 4 in a rearward thrust characteristic of stage 2 dynamic operation of the two-piece reduced energy cartridge of the preferred embodiment. A partially annularly protruding ridge 12, or hereinafter "cog" 12 is shown along with a groove or channel 14. Although not shown, in FIG. 1*b*, the cog 12 and channel 14 stagger further to the right in FIG. 1*b*. The piston sleeve 4 also includes complementary cogs and channels that couple with the one or more cogs 12 and one or more channels 14 of the primary case 2. FIG. 1*c* illustrates a preferably actual size of the cartridge in stage 1, static position.

Figure 2A:
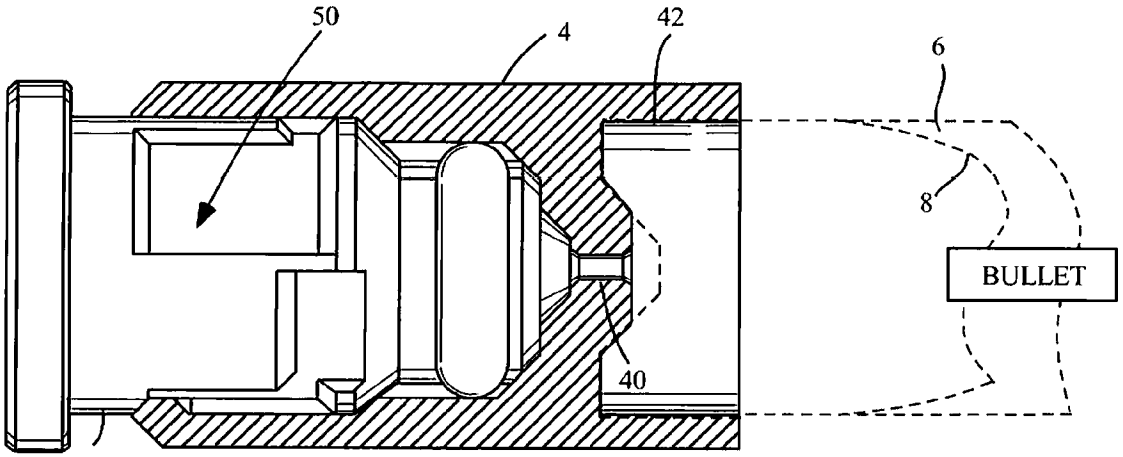
FIG. 2*a* is a view through the piston sleeve of a two-piece, two stage, reduced energy mechanically operating cartridge in the stage 1 (static) position in accordance with a preferred embodiment.
Figure 2B:
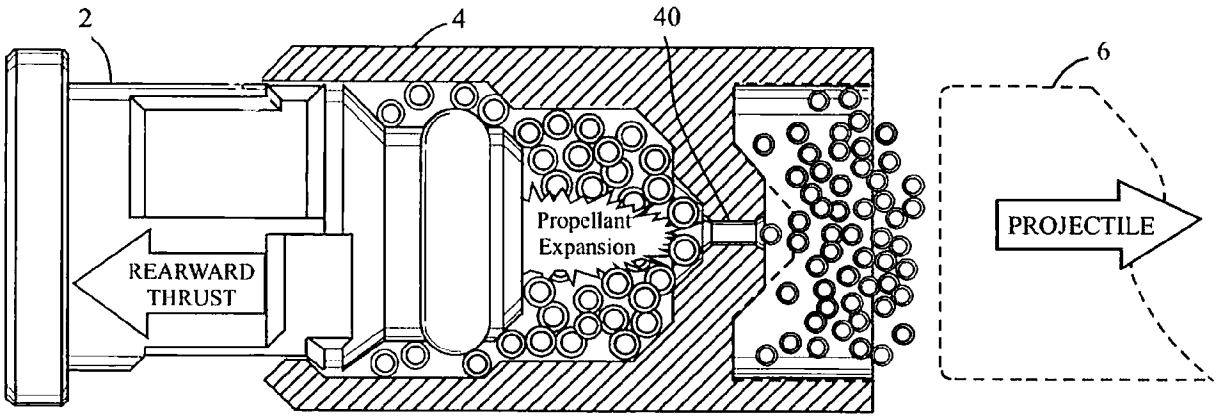
FIG. 2*b* is a view through the piston sleeve of the two-piece, two stage reduced energy mechanically operating cartridge telescoped from the stage 1 (static) position of FIG. 2*a*, and illustrating effects of firing according to stage 2 (dynamic operation), in accordance with a preferred embodiment.

Referring to FIG. 1*d*, an annular protrusion 16, preferably comprising an O-ring, is also shown serving to seal the two-pieces 2, 4 of the cartridge into a stable, static position in stage 1 (see also FIGS. 2*a*-2*b*). This annular protrusion 16 preferably couples complementarily with an annular groove 26 within the sleeve 4. Alternatively, an annular groove of the primary case 2 may be coupled with an annular protrusion of the sleeve 4 interior. In an alternative embodiment, the annular protrusion 16 may be formed from the material that forms the primary case 2, e.g., brass or stainless steel or another durable metal. The protrusion 16 may be part of the piece of material forming the primary case 2. As shown in FIG. 1*d*, the annular protrusion 16 is preferably an O-ring or otherwise separate component coupled or joined with the primary case 2 for seating with the groove 26 of the sleeve 4 (or vice-versa), and in this case may be made from any of a variety of materials such as a metal, rubber or plastic material that is durable to preferably withstand the detonation and firing of the cartridge (such that it may be reused).

FIG. 1*d* also illustrates the internal structures of the case 2 and sleeve 4 that serve to facilitate the coupling of the two pieces 2, 4 of the reusable, reduced-energy, mechanically-operating cartridge of FIGS. 1*a*-1*b* preferably couple together. The primary case 2 is shown in illustrative partial cross-section with its primer cavity 10 for charging the reusable cartridge with a primer cartridge of explosive and/or detonatable material, or for pressurizing, etc., and one or more cogs 12 and one or more channels 14 that couple respectively with complementary channels and cogs (not shown) on the interior of the piston sleeve 4. The cogs 12 and channels 14 shown illustrate a first longitudinal section 12 for axially coupling the primary case 2 with the bullet-containing piston sleeve 4. The section 12 may be longitudinally as short as illustrated, or shorter or longer for reduced or further axial displacement along that section 12. When the axial coupling of the primary case 2 and sleeve 4 reach the end of the section 12, the primary case 2 and sleeve 4 are relatively rotatable.

Upon rotation, cog portions 12*a* of the primary case 2 and complementary ones of the sleeve 4, which move along channel 32 of the case, become overlapped, so that the primary case 2 and sleeve 4 are no longer separable by straight axial or telescope-like separation. In ordinary operation, these angularly overlapping cog portions 12*a* of the case 2 and corresponding cogs of the sleeve 4, overlapping by movement through channel 32 during rotation, serve to prevent the separation of the case 2 and sleeve 4 upon dynamic activation in stage 2. As referred to above, however, in stage 2 dynamic operation, the cog portions 12*a*, and corresponding cogs of the sleeve 4, may be preferably configured to shear to reduce further the energy of the projectile. These cog portions 12*a* of the primary case 2 are shown angularly extending from one end of the longitudinal portions of the cogs 12 to overlap channels between complementary cogs of the sleeve 4 after the relative rotation of the case 2 and sleeve 4 following their initial axial coupling by relative axial or longitudinal movement. This in part permits the case 2 and sleeve 4 to remain coupled, absent the described shearing action, within the chamber upon firing and release of the bullet 6,8 down the barrel of the non-lethal firearm.

After the relative rotation, the primary case 2 and piston sleeve 4 are preferably further axially moved until they reach the static, stage 1, position illustrated at FIGS. 1*a* and 2*a*. At the static, stage 1 position, preferably the annular protrusion 16 of the primary case 2 is coupled with the annular groove 26 at the interior of the sleeve to provide stability and consistency to the static stage 1 position. As alternative embodiments, the annular protrusion 16 and groove 26 may be interchanged to a groove within the case 2 and a protrusion within the sleeve 4, and/or the sleeve 4 may be differently configured to insert within the case 2 rather than the case 2 inserting within the bullet sleeve 4.

The primary case 2 of FIG. 1*d* includes a narrow cylindrical portion 28, with a bevel at the end, which couples into a complementarily narrow cylindrical cavity portion 30 of the bullet sleeve 4, with a corresponding bevel at its end. A second cylindrical insertion portion 32 of the primary case 2 couples with a complementary cavity 34 within the sleeve 4, including another complementary pair of bevel rings. A third end portion 36 does not insert into the sleeve 4 in the preferred embodiment. An alternative embodiment may have the primary case 2 fully inserted inside the bullet sleeve 4 although flat with the end of the cavity 34 of the sleeve 4 would be best in this alternative so that the primer cartridge within the primer cavity 10 can be easily accessed for detonation.

There is a flash hole 40 connecting the cavity 30 with a projectile cavity 42 also defined within the piston sleeve 4. The projectile cavity 42 is configured to couple with a projectile 6,8. Although not shown in FIG. 1*d*, the preferred projectile 6 or bullet 6 includes etched sides for ease of plastic separation upon impact. In addition, the primary case cavity 10 may include multiple inwardly protruding fins that allow a primer cartridge or other propellant mechanism to firmly couple with the cavity 10, such as to gently protrude into the material (e.g., copper, particularly of a primer cartridge casing). Alternatively, a primer cartridge may have such outwardly protruding fins for the same purpose, and the primer cartridge or other propellant mechanism such as a pressurized gas container or port or connecting mechanism attached thereto may couple within the primer cavity 10 without the assistance of fins.

FIGS. 2*a*-2*b* illustrate the cartridge in static stage 1 position and in dynamic stage 2 condition, respectively, in view through the wall of the piston sleeve 4. The cartridge includes a primer cavity 50 at a hollowed interior of the case 2 within which a detonating cartridge (not shown) may be inserted. The case 2 is stably resting within a hollowed interior of the sleeve 4 when the cartridge is fully compressed in the longitudinal or axial direction during stage 1. In the FIG. 2*a* view, the firing hole 40 is seen connecting the primer cavity 50 with the projectile cavity 42 within which the projectile 6,8 is resting.

Figures 2C, 2D:
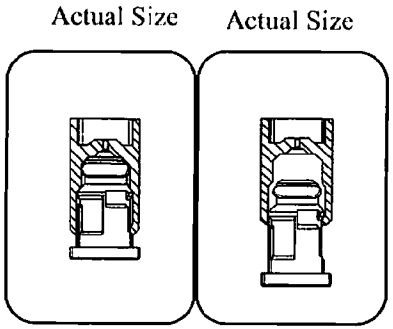
FIG. 2*c* illustrates an actual size of the cartridge of FIG. 2*a*, in cross-section, in the stage 1 (static) position.
FIG. 2*d* illustrates an actual size of the cartridge of FIG. 2*b*, in cross-section, in a stage 2 (dynamic; telescoped) position.

FIG. 2*b* illustrates how, upon detonation of a cartridge that is within primer cavity 50, the case 2 thrusts rearward expanding the volume of the propellant gas within combined cavities 50 and the hollow interior of cylinder portion 28 of the case 2 and sleeve 4 reducing the energy conveyed to the projectile. The expansion of propellant gas is illustrated clearly showing that pressure builds up on the projectile through the firing hole 40. The projectile 6 releases down the barrel of a non-lethal firearm as a result. FIGS. 2*c*-2*d* respectively illustrate actual sizes of the cartridge in a view through an outer wall of the piston sleeve 4 in the static stage 1 position and in the dynamic stage 2 condition.

Figure 3A:
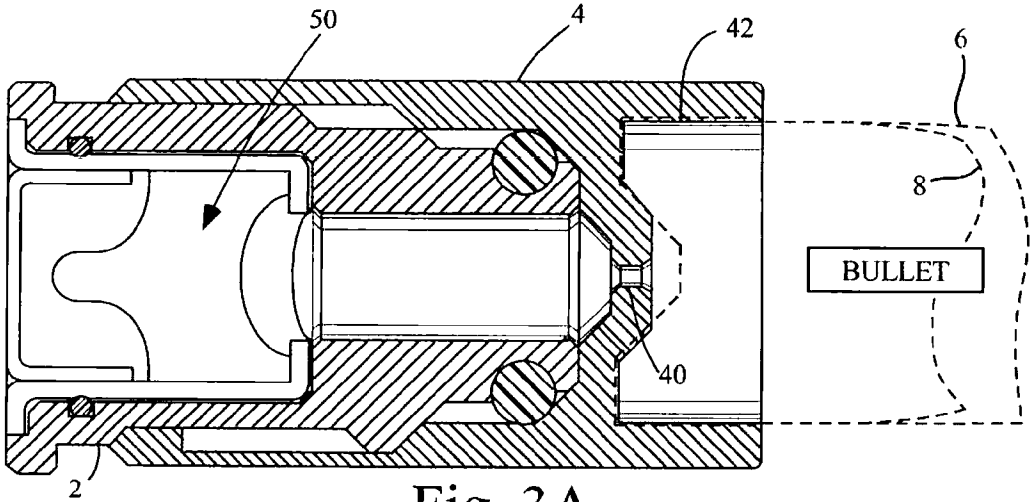
FIG. 3*a* illustrates in cross-section a two-piece, two stage, reduced energy mechanically operating cartridge in the stage 1 (static) position in accordance with a preferred embodiment.

FIG. 3*a* is a cross-sectional view of the two-piece, two stage non-lethal, sub-lethal or lethal, reduced energy, mechanically operating cartridge in a static, stage 1 position in accordance with a preferred embodiment. A propellant unit 50 within a primer cavity 10 at the interior of the case 2 may include a primer cartridge containing detonating and/or exploding material or pressurized gas or a coupling thereto. The primary case 2 of FIG. 3*a* shows a cylindrical portion 28 having defined therein a hollow interior. The hollow interior cavity of the cylindrical portion 28 may be right cylindrical as in FIG. 1*d*, or the cavity may have a steadily increasing radius from the primer cavity 50 towards the flash hole 40 that fluidly couples the cavity of the cylindrical portion 28 and the propellant cavity 42. Alternatively, the cavity of the cylindrical portion 28 may have another suitable shape that permits expanding gas within the cavity of the cylindrical portion 28 to flow appropriately to permit the telescoping of the primer base 2 and bullet sleeve 4 and ultimately the release of the projectile 6,8, i.e., upon firing or detonation of the primer cartridge 50 or propellant unit 50 that is charging the NLAT cartridge within the primary case cavity 10.

Figure 3B:
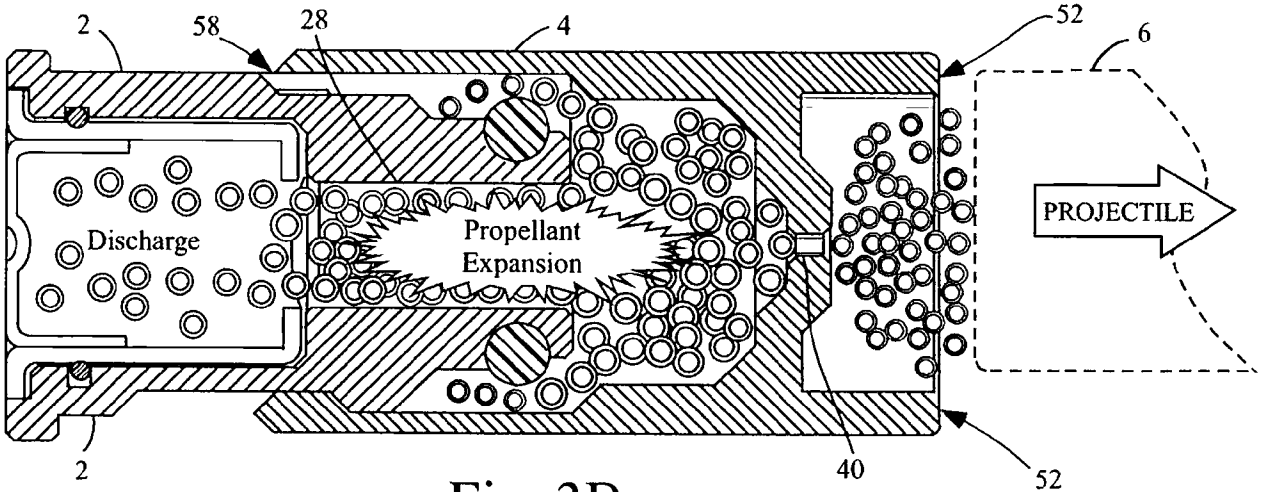
FIG. 3*b* illustrates in cross-section a two-piece, two stage reduced energy mechanically operating cartridge telescoped from the stage 1 (static) position of FIG. 3*a*, and illustrating effects of firing according to stage 2 (dynamic operation), in accordance with a preferred embodiment.

FIG. 3*b* is a cross-sectional view of the two-piece, two stage, non-lethal mechanically operating cartridge telescoped from the static position of FIG. 3*a*, into the dynamic stage 2 condition illustrating effects of firing, in accordance with a preferred embodiment. The NLAT cartridge is shown telescoping from the static position illustrated at FIG. 3*a* due to the pressure of the gas expansion within cavity of the cylindrical portion 28 upon firing of the propellant mechanism 50. Gas pressure also rapidly builds up where the projectile 6,8 and flash hole 40 meet. When the telescoping reaches its maximum extent due to the coupling of the primary case 2 with the piston sleeve 4, the projectile 6,8 releases from the cavity 42 down the barrel of a NLAT firearm. The release of the projectile 6,8 from the cavity 42 is also facilitated by the etched sides described with reference to FIG. 1*d*.

Figure 3C:
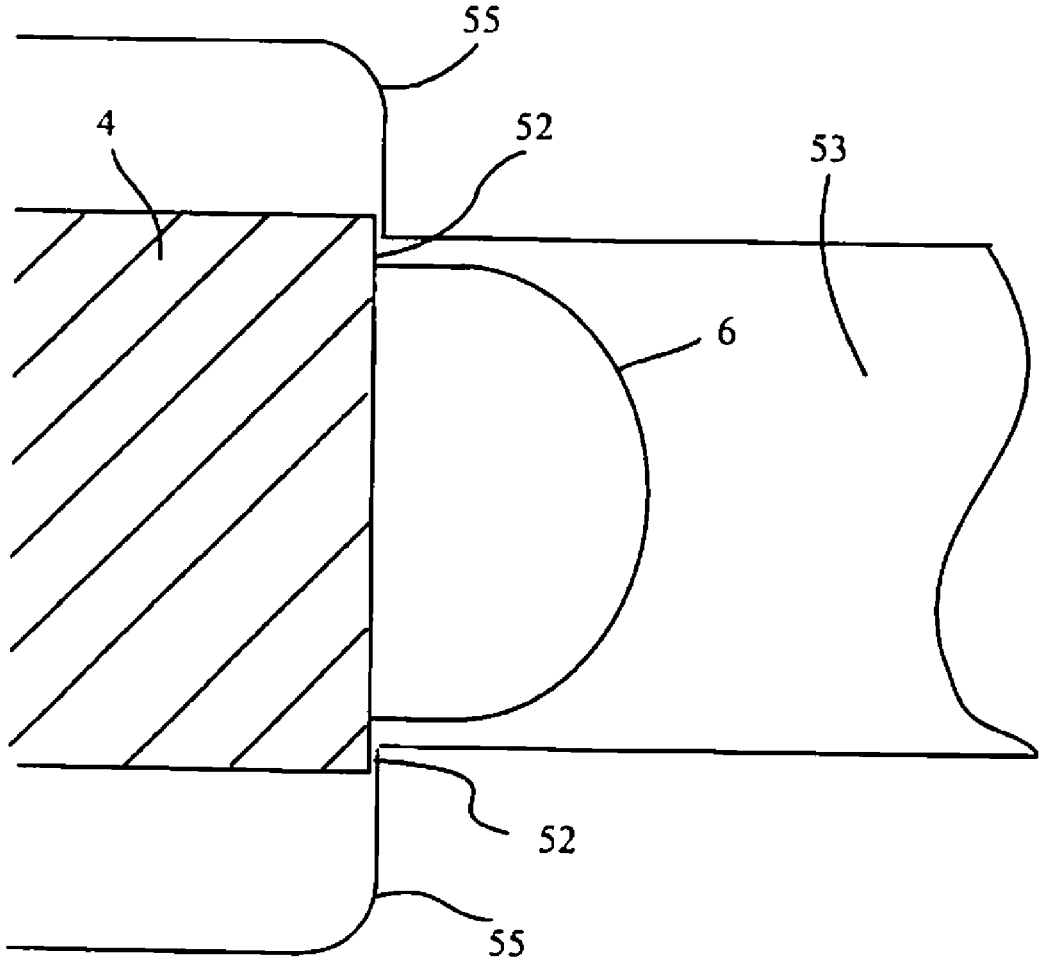
FIG. 3*c* illustrates relative diameters of the piston sleeve of the two stage, reduced energy cartridge of FIGS. 3*a*-3*b* and a barrel of a firearm used to discharge the cartridge.

This maximum telescoping is preferably facilitated and/or determined in accordance with one or more of the following features of the NLAT cartridge of the preferred embodiment which will each be described in more detail below. First, the primary case 2 and the piston sleeve 4 preferably have one or more complementary and partially annular ridges, which may be channel/cog pairs, or inward/outward protrusion pairs. These are offset when the case 2 and sleeve 4 are initially coupled, e.g., with cogs 12 of the case 2 aligning with channels of the sleeve 4, and cogs of the sleeve 4 aligning with channels of the case 2. Note that the channels may be particularly carved or may simply comprise areas between cogs. Then, the case 2 and sleeve 4 are relatively rotated to overlap cog portions 12*a* of the case 2 and ridges of the sleeve 4 so that where these cog portions 12*a* meet angularly overlapping cog portions of the sleeve, a maximum telescoping extent is defined (again, unless the cog portions 12*a* and/or those of the sleeve 4 shear to reduce the projectile energy). Second, the shoulders 52 of the piston sleeve 4 illustrated at FIG. 3*a* preferably define a diameter of the sleeve 4 that is greater than a diameter of the barrel 53 of the NLAT firearm from which the NLAT ammunition cartridge is fired. Referring now to FIG. 3*c*, where the shoulders 52 of the sleeve 4 meet the shoulders 55 of the barrel 53 of the NLAT firearm, and the primary case 2 is thrust away from the sleeve 4 upon firing, then a maximum telescoping of the sleeve 4 from the base 2 is ultimately reached.

An optional vent 58 is also illustrated at FIG. 3*b*. The vent 58 is designed to relieve the pressure within the cavity of the cylindrical portion 28 an appropriate amount to achieve a sufficient balance. The vent 58 may be utilized to provide a balance with respect to safety as well, and may serve to reduce the energy of the projectile further. The propellant units 50 release a predetermined average amount of energy with a narrow statistical deviation. However, when the energy released is higher than average, the pressure could quickly build too high and the firearm could fail or other malfunction could occur. The advantageous vent 58, however, can release an enhanced amount of the expanding gas during the firing and potentially prevent the dangerous safety situation described above.

FIG. 4*a* illustrates a propellant unit 50 in accordance with a preferred embodiment. The preferred propellant unit 50 is a primer cartridge 50 generally made from copper or other light metal and is filled with an explosive material. The cartridge 50 and primer cavity 10 (see FIG. 1*d*) are designed to couple firmly together. The advantageous fins described above with reference to FIG. 1*d* may be used facilitate this firm coupling, in addition to the snap ring of FIG. 4*b*.

FIG. 4*c* illustrates a primary case 2 in accordance with a preferred embodiment. A longitudinal cog portion 12 and an angular cog portion 12*a* are shown. The primary case 2 may include additional cogs 12 than those shown in FIG. 4*c*. Note that the cog 12 that is shown includes portion 12*a* that angularly overlaps with the channel 14. This portion 12*a* of the cog 12 overlaps a complementary, preferably inwardly protruding cog of the sleeve 4 when the case 2 and sleeve 4 are relatively rotated after axial coupling. An annular O-ring 16 is shown in FIG. 4*d* for coupling with a complementary annular groove 26 of the sleeve 4, or just to seat with the wall of cavity 30 of the interior of the sleeve 4 as described with reference to FIG. 1*d*, tending to stabilize the two-piece configuration at its most compressed position when it is loaded and charged and ready to be utilized in conjunction with a NLAT firearm.

FIGS. 4*e* and 4*f* illustrate, respectively, a piston sleeve 4 and a projectile 6,8 in accordance with a preferred embodiment. The sleeve 4 shown has an outer cylindrical shape. Certain terms describing features of the sleeve are shown including shoulder, mouth, throat and hips. The label "cogs" is shown over where a cog of the sleeve 4 preferably resides within the sleeve 4, although not shown in FIG. 4*e*. The projectile 6,8 of FIG. 4*f* is as already described with reference to FIG. 1*a*.

Figure 4G:
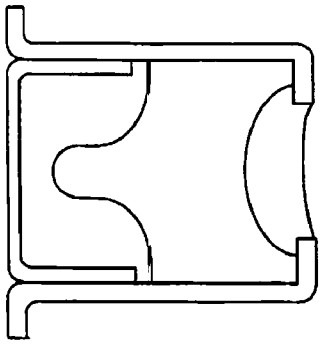
Figure 4H:
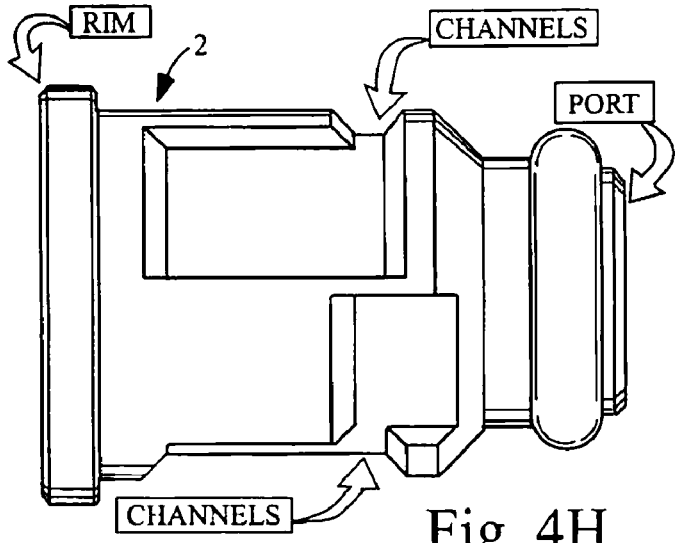
Figure 4I:
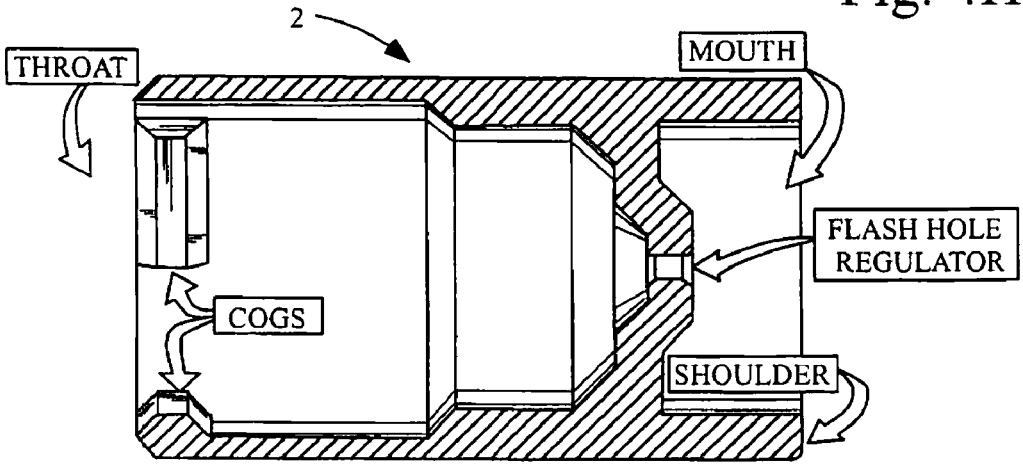

FIG. 4*g* illustrates a cross-sectional view of a preferred propellant unit 50 of FIG. 4*a*. This view illustrates a contour of the content of the propellant unit. FIG. 4*h* illustrates the primary case with O-ring coupled at the port end. This view is otherwise the same as FIG. 4*c* with the O-ring of FIG. 4*d* attached. FIG. 4*i* illustrates a view through the outer casing of the piston sleeve revealing inner structure in accordance with a preferred embodiment. The cogs of the piston sleeve 4 are particularly illustrated, along with the flash hole and shoulders.

Figure 5C:
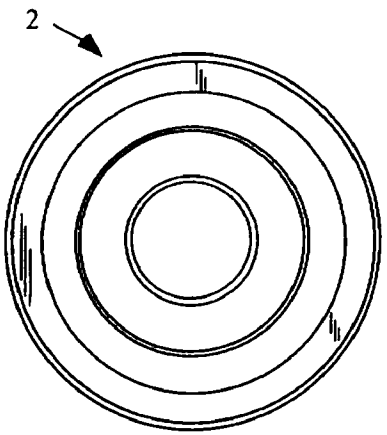
FIG. 5*c* illustrates a rim end view of the primary case of FIGS. 5*a*-5*b* with snap ring of FIG. 4*b* installed at the opposite end for coupling with a propellant unit in accordance with a preferred embodiment.
Figure 5B:
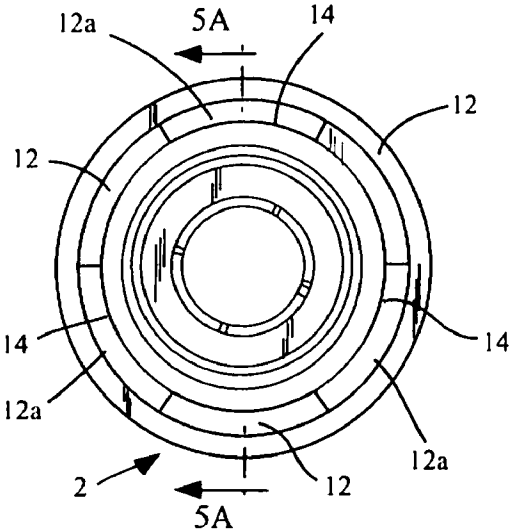
FIG. 5*b* illustrates a port end view of the primary case of FIG. 5*a* at the end including cogs for coupling with a piston sleeve in accordance with a preferred embodiment.
Figure 5A:
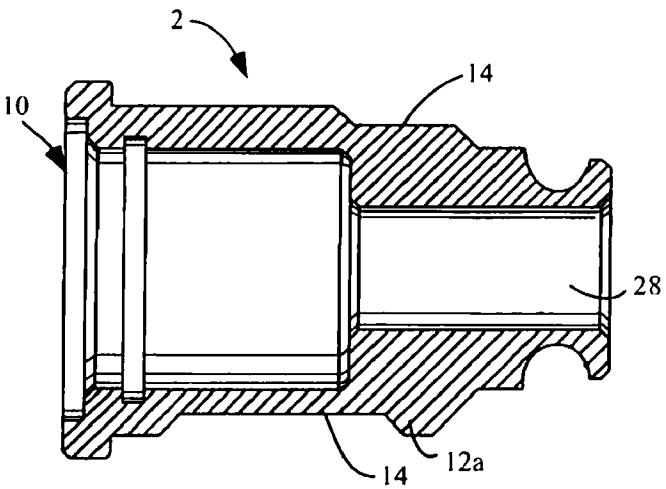
FIG. 5*a* illustrates a view through the outer wall of a primary case in accordance with a preferred embodiment revealing inner structure.

FIG. 5*a* illustrates a view through the outer wall of the primary case 2 in accordance with a preferred embodiment. The primer cavity 10 and cavity 28 are illustrated. Portions of channels 14 and one of the overlapping cog sections 12*a* are illustrated.

FIG. 5*b* illustrates an end view of the primary case 2 of FIG. 5*a* at the end including the cog portions 12*a* in accordance with a preferred embodiment. The channels 14 are shown in this end view as overlapping angularly with the cog portions 12*a*. Thus, it is illustrated in FIG. 5*b* how the complementary cogs of the sleeve 4 when coupled into channels 14 are angularly overlapped with cog portions 12*a*. The longitudinal cog portions 12 are shown angularly offset from the cog portions 12*a*. FIG. 5*c* illustrates an end view of the primer cavity of the primary case 2 and snap ring assembly of FIGS. 5*a*-5*b* at the opposite end for coupling with a primer cartridge in accordance with a preferred embodiment.

Figure 6C:
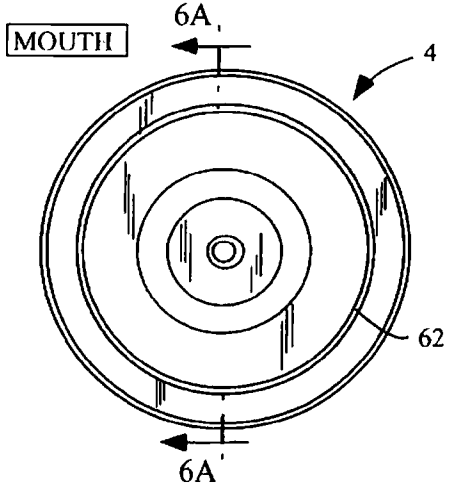
FIG. 6*c* illustrates a mouth end view of the piston sleeve of FIG. 6*a* for coupling with a bullet in accordance with a preferred embodiment.
Figure 6B:
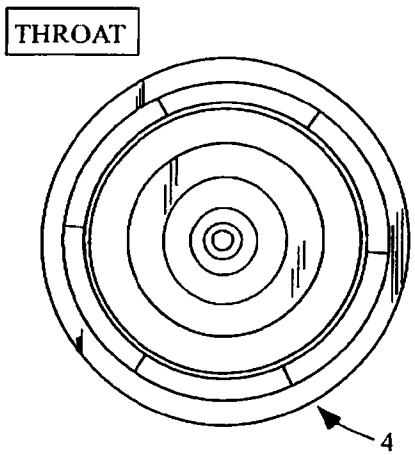
FIG. 6*b* illustrates a throat end view of the piston sleeve of FIG. 6*a* including cogs for coupling with the primary case of FIGS. 5*a*-5*c* in accordance with a preferred embodiment.
Figure 6A:
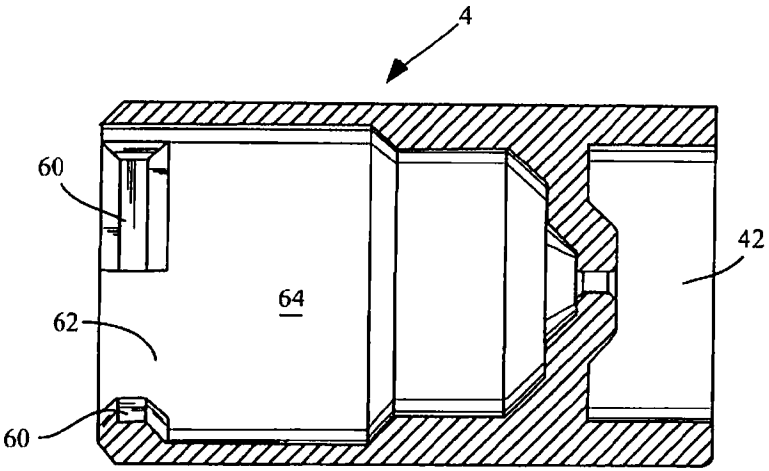
FIG. 6*a* illustrates a view through the outer wall of a piston sleeve in accordance with a preferred embodiment revealing inner structure.

FIGS. 6*a*-6*c* illustrates a view through the outer wall of a piston sleeve 4 in accordance with a preferred embodiment. The sleeve 4 has a preferably cylindrical shape on the outer surface. At the end which is the left in FIG. 6*a*, a primary case 2 may be coupled with the sleeve 4 as described above. Partially annular cogs 60 are shown that are for mating with channels 14 of the case 2. The outside of partially annular channels 62 are illustrated disposed angularly between the cogs 60. The axial coupling of the case 2 and sleeve 4 involves a cog portion 12*a* (see FIGS. 4*c* and 5*a*, e.g.) of a case 2 initially sliding within channel 62, while a channel 14 of the base initially slides axially along a channel 62 of the sleeve 4. At this point, the cog portions 12*a* and the protrusions 60 are not angularly overlapped and are instead fully offset. When the one or more cog portions 12*a* have axially displaced far enough, i.e., so as to not axially overlap the protrusions 60, then the case 2 and sleeve 4 may be relatively rotated until the cog portion(s) 12*a* are now overlapping the cogs 60. At this point, the cog portion(s) 12*a* are coupled within "channel" 64. "Channel" 64 is not really a channel in the sense that preferably there are no protrusions angularly adjacent to them. However, channel 64 represents an axial extent of the sleeve 4 between the partially annular cogs 60 and the other end of the sleeve 4 that is proximate the flash hole 40. The inner diameter of the sleeve 4 at channels 64 is greater axially after the protrusions 60 than where the protrusions 60 are present. Upon firing, the telescoping of the case 2 and sleeve 4 have a maximum where the cog portions 12*a* meet the protrusions 60, while the shoulder 55 of the firearm (see FIG. 3*c*) remains in contact with the shoulder 52 of the sleeve 4, preferably such that the sleeve 4 and primer case 2 actually remain coupled within the chamber of the NLAT firearm when the projectile 6,8 is released down the barrel. As mentioned, to reduce energy, the cog 60 and/or cog portions 12*a* may shear such that the case 2 and sleeve 4 actually separate.

FIG. 6*b* illustrates an end view of the piston sleeve 4 of FIG. 6*a* at the end for coupling with a projectile 6,8 of non-lethal composition in accordance with a preferred embodiment. FIG. 6*c* illustrates an end view of the piston sleeve of FIGS. 6*a*-6*b* at the opposite end including cogs 60 for coupling with the primary case 2 of FIGS. 5*a*-5*c* in accordance with a preferred embodiment.

FIGS. 7*a*-7*g* illustrate a sequence of operations for the two-stage, reduced energy cartridge of the preferred embodiment. These figures illustrate a first assembly of the cartridge into stage 1, static condition, through stage 2, dynamic condition upon activation or discharge, and then through uncoupling and recoupling again into a recharged, reloaded, stage 1, static cartridge for reuse.

Figure 7A:
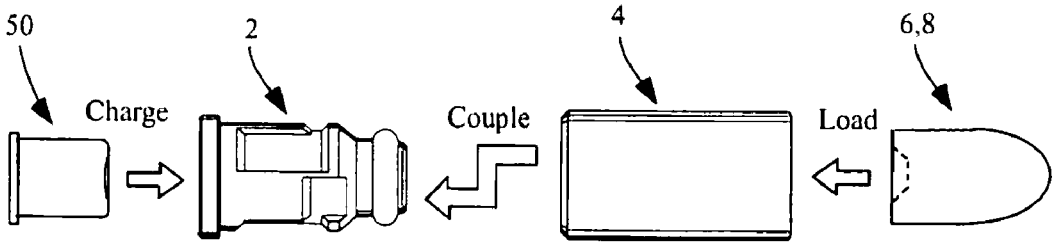
FIGS. 7*a*-7*g* illustrate a sequence of operations for the two-stage, reduced energy cartridge of the preferred embodiment.
Figure 7B:
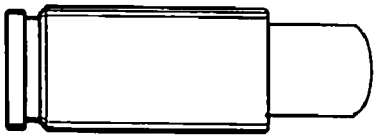

FIG. 7*a* illustrates coupling of components in an exploded view of the two-stage cartridge of the preferred embodiment. The components shown include the primary case 2 and piston sleeve 4, along with the projectile 6,8 and primer cartridge 50. The arrows indicate how the components are coupled together. The projectile is "loaded" straight into the projectile cavity of the sleeve 4, and the primer cartridge 50 is "charged" directly into the primer cavity of the primary case 2. The primary case 2 and piston sleeve 4 are first axial coupled straight together with cogs 12*a* of the case 2 matching channels of the sleeve 4, and/or vice-versa. Then, the two 2,4 are relatively rotated. Finally, the two 2,4 are further compressed together axially cogs of the sleeve 4 matching channels 14 of the case 2 until the stage 1, static position is reached. FIG. 7*b* illustrates the cartridge in static condition (stage 1).

Figure 7C:
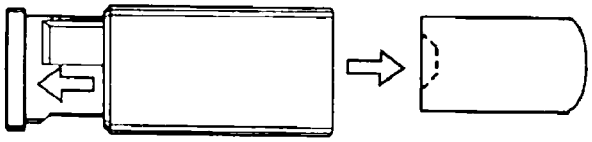

FIG. 7*c* illustrates the cartridge in dynamic condition (stage 2). One arrow indicates that the projectile moves straight away from the piston sleeve 4. Another arrow indicates that the primary case 2 move straight rearward from the piston sleeve 4. The piston sleeve is indicated as remaining in a same position from stage 1 through stage 2.

Figure 7D:
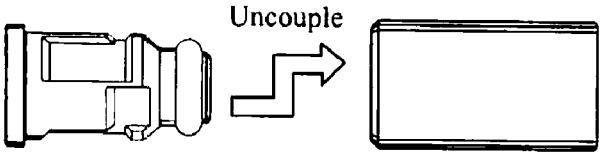

FIG. 7*d* illustrates the uncoupling of the piston sleeve from the primary case. This uncoupling occurs just the opposite as the coupling describes with reference to FIG. 7*a*. First, the cogs of the sleeve 4 are slid axially along channel 14 of the case 2. Then, the two 2,4 are relatively rotated until the cog portions 12*a* of the case 2 and the cogs of the sleeve 4 are completely offset. Then, the two 2,4 are axially separated. If the cogs 12*a* and/or cogs of the sleeve 4 are sheared during the dynamic event of the stage 2 firing, then the case 2 and sleeve 4 will be already separated, and this uncoupling will be skipped. In addition, the case 2 and/or sleeve 4 having sheared cogs will not be recharged and/or reloaded into another stage 1 cartridge.

Figure 7E:
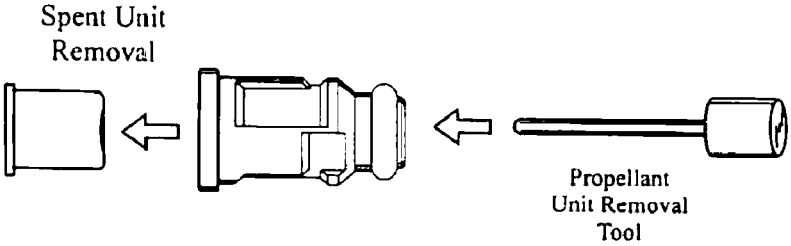

FIG. 7*e* illustrates removal of the spent propellant unit from the primary case. A propellant unit removal tool may be used which inserts through the firing hole 40 (see FIGS. 1*d*, 2*b*), contacts the spent unit and pushes it until it completely removes from the case 2, or sufficiently removes from the case 2 so that it can easily be manually separated from that point.

Figure 7F:
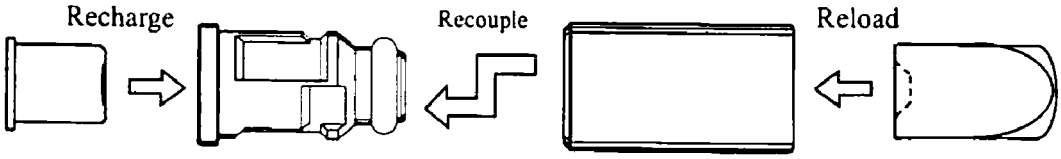
Figure 7G:
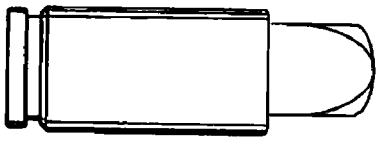

FIG. 7*f* illustrates the recharging, recoupling and reloading of the cartridge. FIG. 7*g* illustrates the recharged, recoupling and reloaded cartridge of FIG. 7*f* in reusable, static condition (stage 1). FIGS. 7*f* and 7*g* are the same as FIGS. 7*a* and 7*b* are included to shown that the case 2 and sleeve 4 may be "reloaded" with a new projectile, and "recharged" with a new primer case, as well as being recoupled together, such that all form another stage 1 cartridge.

Figures 8A, 8B, 8C:
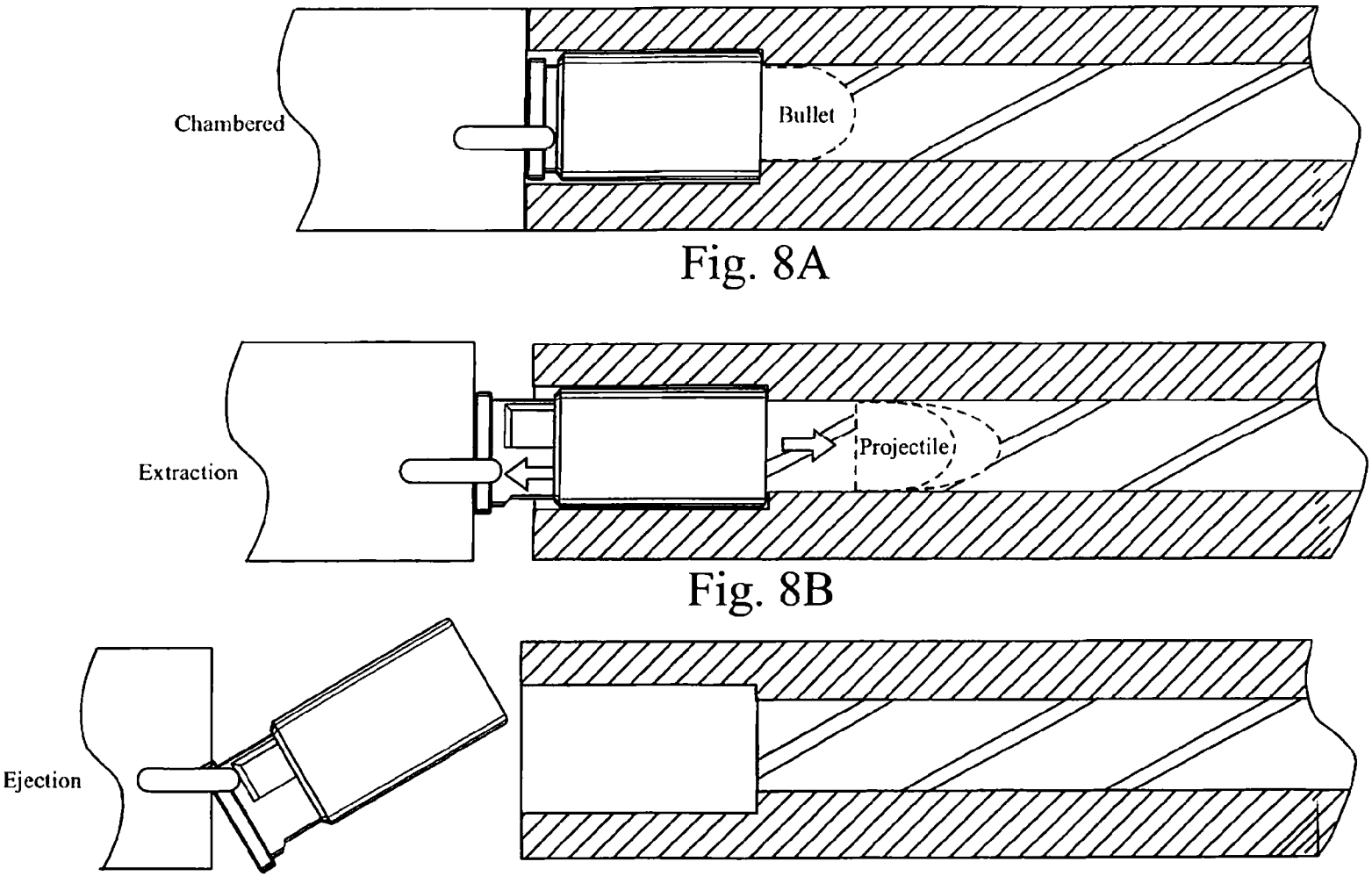
FIGS. 8*a*-8*c* illustrate operations of the two stage, reduced energy cartridge of the preferred embodiment within modified or dedicated firearms.

FIGS. 8*a*-8*c* illustrate operations of the two stage, reduced energy, mechanically-operating cartridge of the preferred embodiment within modified or dedicated firearms. FIG. 8*a* illustrates a chambered cartridge in stage 1 (static) condition. The shoulders 52 and 55 of the sleeve 4 and the firearm, respectively, as shown contacted within the chamber. The bolt or slide is flush with the rim of the case 2 when the cartridge is chambered. FIG. 8*b* illustrates extraction of the cartridge in stage 2 (dynamic) condition. The projectile 6,8 is shown propelling down the barrel of the firearm and the case 2 is shown thrusting rearward against the bolt or slide pushing it rearward reducing the projectile energy compared with a firearm and cartridge wherein the bolt or slide did not move rearward upon rearward thrust of the primary case. FIG. 8*c* illustrates ejection of the cartridge after discharge when the bolt or slide is pulled sufficiently back.

Figures 9A, 9B, 9C, 9D:
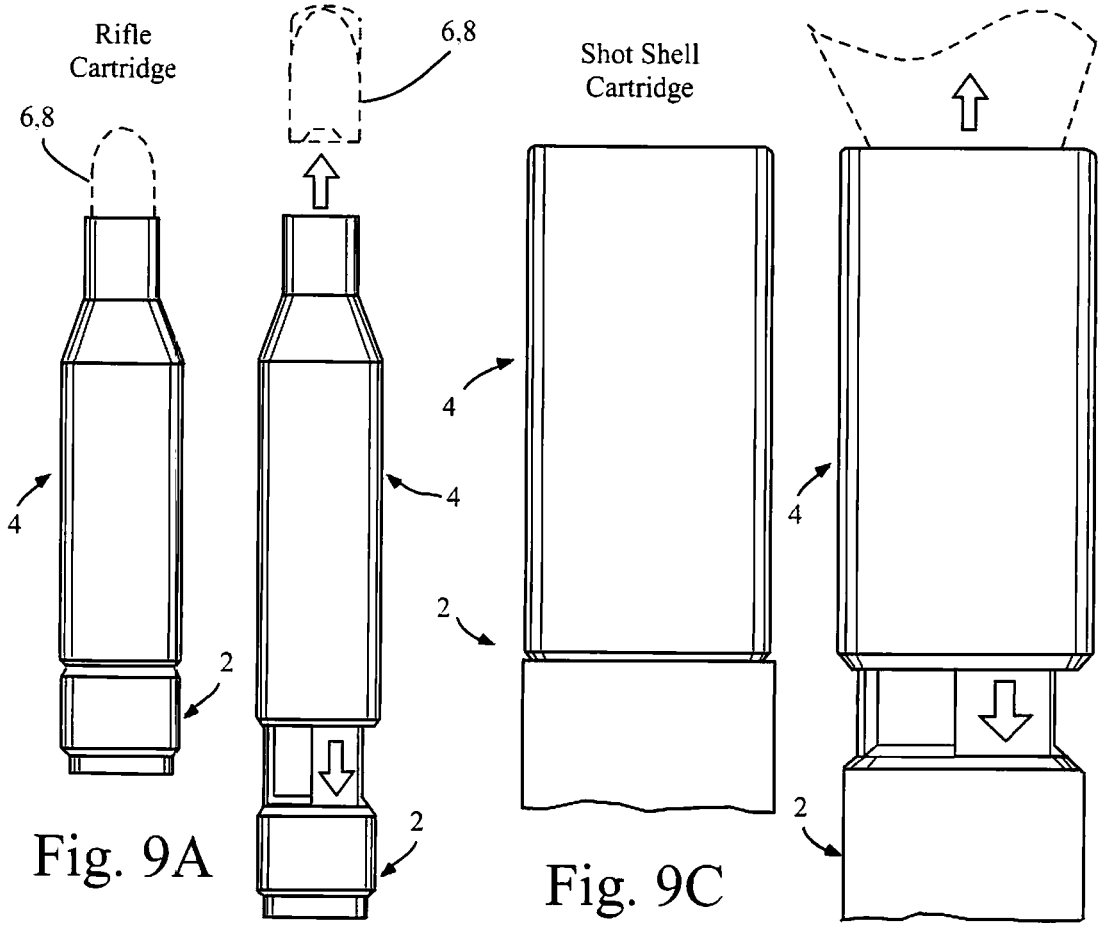
FIG. 9*a* illustrates a two stage, reduced energy rifle cartridge in stage 1 (static) condition.
FIG. 9*b* illustrates the rifle cartridge of FIG. 9*a* in stage 2 (dynamic) condition.
FIG. 9*c* illustrates a two stage, reduced energy shot shell cartridge in stage 1 (static) condition.
FIG. 9*d* illustrates the shot shell cartridge of FIG. 9*c* in stage 2 (dynamic) condition.

FIG. 9*a* illustrates a two stage, reduced energy rifle cartridge in stage 1 (static) condition. FIG. 9*b* illustrates the rifle cartridge of FIG. 9*a* in stage 2 (dynamic) condition. The primary case 2 is shown thrusting rearward while the projectile propels forward.

FIG. 9*c* illustrates a two stage, reduced energy shot shell cartridge in stage 1 (static) condition. FIG. 9*d* illustrates the shot shell cartridge of FIG. 9*c* in stage 2 (dynamic) condition. As with the rifle cartridge, the case 2 thrusts rearward when the shot projectile or shot projectiles propel forward.

While an exemplary drawing and specific embodiments of the present invention have been described and illustrated, it is to be understood that that the scope of the present invention is not to be limited to the particular embodiments discussed. Thus, the embodiments shall be regarded as illustrative rather than restrictive, and it should be understood that variations may be made in those embodiments by workers skilled in the arts without departing from the scope of the present invention which is set forth in the claims that follow and includes structural and functional equivalents thereof.

For example, in addition to that which is described as background, the brief description of the drawings, the abstract and the invention summary, U.S. Pat. Nos. 4,899,660, 5,016,536, 5,121,692, 5,219,316, 5,359,937, 5,492,063, 5,974,942, 5,520,019, 5,740,626, 5,983,773, 5,974,942, 6,276,252, 6,357,331, 6,442,882, 6,625,916, 5,791,327, 6,393,992, 6,374,741, 5,962,806, 6,672,218, 6,553,913, 6,564,719, 6,250,226, 5,983,548, 5,221,809, 4,270,293 and 5,983,773, are hereby incorporated by reference into the detailed description of the preferred embodiments, as disclosing alternative embodiments of elements or features of the preferred embodiments not otherwise set forth in detail. A single one or a combination of two or more of these references may be consulted to obtain a variation of the preferred embodiments described in the detailed description.

Portions of the primary case 2, piston sleeve 4 and projectile 6,8 have been described as cylindrical or substantially cylindrical. These shapes may differ from cylindrical into any shape that permits the case 2 to be coupled with the sleeve 4 and then to telescope upon firing. Thus, a "substantially cylindrical jacket" may be preferably similar to those shown in the drawings or may be another shape different from purely or very nearly cylindrical, as long as they may couple, telescope and fire to produce the desired resulting non-lethal projectile velocity.

In addition, herein it is described that a piston sleeve 4 and a primary case 2 are initially axially coupled. This term is meant to describe the relative displacement of the sleeve 4 and case 2 along a long axis, which is a longitudinal cylindrical axis in a preferred embodiment. In the of this axial displacement, the sleeve 4 and case 2 become coupled either by the sleeve 4 radially overlapping the case 2 (or the case 2 inserting into the sleeve 4), or the case 2 radially overlapping the sleeve 4 (or the sleeve 4 inserting into the case 2), or a combination of these such as by an interlocking coupling. The relative rotational displacement that is described is generally around this preferred longitudinal axis and involves relative rotational displacement of the sleeve 4 and case 2.

Also, ridge portions, cogs, and partially annular protrusions are recited herein each to generally include protruding sections from a general contour. The protruding sections extend either inwardly from the inner walls of a cavity, which is substantially cylindrical according to a preferred embodiment, or outwardly from an outer surface of a complementary piece being coupled into the cavity. In a preferred embodiment, the primary case 2 has cogs, or ridge portions or partially annular protrusions, that match channels of the sleeve 4, and the sleeve has partially annular protrusions or ridge portions or cogs that protrude inwardly and match channels disposed between the cogs of the primary case 2. The protrusions, cogs or ridges may preferably form part of a single piece of machined material of the base and/or sleeve, or alternatively may be coupled with the bulk of either of these pieces. Channels may include particular machining or may simply be the absence of protruding material. Likewise, the protrusions, or cogs, may include particular machining or may be location where channels or grooves have not been machined.

The primary case 2 and piston sleeve 4 of the two-piece, two stage mechanically operating cartridge are recited as including "substantially non-deformable" jackets. This means that upon firing, generally these jackets either do not deform at all, or at least do not deform so much that they are not reusable. They may deform so little that they may be used in slightly deformed condition, or such that their material may be worked back into usable shape, e.g., as metals may be typically worked by hand tools or with machines typically found in a metal machine shop. In contrast, the deformable primer bases of conventional non-lethal ammunition cartridges typically render them non-reusable such that they are generally thrown away after one use. The materials conventionally used includes plastics or other polymer-based materials that may perhaps be reused upon remolding of the material, which is to say that new pieces are formed from the previously used material, but not that the piece itself is reused.

The cog portions 12*a* of FIGS. 5*a*-5*c* of the primary case 2 and/or the ridges 60 of FIGS. 5*a*-5*c* of the piston sleeve 4 may be configured with many different shapes. In addition, the cog portions 12*a* and/or the ridges 60 may be configured to break away, e.g., when the cog portions 12*a* and ridges 60 meet during the telescoping of the two-piece, two stage cartridge. In this case, the case 2 and sleeve 4 may de-couple and may be extracted and/or ejected separately or together. Preferably, when the case 2 and sleeve 4 telescope, the case 2 move to the rear of the chamber of the non-lethal dedicated or modified firearm causing the extractor of the firearm to extract the case 2 until the ejector of the firearm ejects the cartridge.

In addition, in methods that may be performed according to the claims and/or preferred embodiments herein and that may have been described above and/or recited below, the operations have been described and set forth in selected typographical sequences. However, the sequences have been selected and so ordered for typographical convenience and are not intended to imply any particular order for performing the operations unless expressly set forth in the claims or understood by those skilled in the art as being necessary.

I claim:

1. A two-piece, two-stage, reduced energy mechanically-operating cartridge for launching a projectile from a dedicated or modified firearm, comprising:

(a) a piston sleeve comprising a piston sleeve jacket defining a projectile cavity at a first longitudinal end for coupling the projectile therein, and a second end for coupling with a primary case, and the piston sleeve including one or more partially annular protrusion portions (hereinafter "cogs") or channels or both; and (b) the primary case comprising a primary case jacket for being axially coupled with the second end of the piston sleeve, and including one or more complementary partially annular cogs or channels, or both, to those of the piston sleeve, and defining a primary case cavity for coupling with a propellant mechanism, (c) wherein said primary case and piston sleeve are configured such that an axial coupling of the primary case with the second end of the piston sleeve involves mating of the complementary cogs and channels of the primary case and piston sleeve, and (d) wherein said primary case and piston sleeve are further configured such that upon the axial coupling of the piston sleeve and primary case and at least partial compression together, the primary case and the piston sleeve become relatively rotationally movable with regard to the cogs traveling within the channels, followed by relative axial movement to a fully compressed configuration, such that upon activation, when the piston sleeve and primary case telescope from the static position, the cogs move in the opposite axial direction within the channels.

2. The cartridge of claim 1, wherein the piston sleeve comprises two or more spaced apart cogs.

3. The cartridge of claim 2, wherein the primary case comprises two or more channels for mating with the complementary cogs of the piston sleeve.

4. The cartridge of claim 3, wherein the cogs of the piston sleeve comprise three or more spaced-apart cogs.

5. The cartridge of claim 1, wherein the piston sleeve comprises a shoulder, such that upon activation when the piston sleeve and primary case are telescoping from the static position, said shoulder contacts an step between a chamber and a barrel of a firearm preventing the sleeve from advancing down the barrel, and instead the primary case thrusts rearward away from the barrel.

6. The cartridge of claim 1, wherein the piston sleeve and the primary case include an annular protrusion, in addition to said cogs, for axially stabilizing the coupling of the piston sleeve and the primary case in the static position.

7. The cartridge of claim 1, wherein the jacket of the piston sleeve comprises a substantially non-deformable material, such that the piston sleeve jacket is reusable.

8. The cartridge of claim 7, wherein the jacket of the primary case also comprises a substantially non-deformable material, such that the primary case jacket is reusable.

9. The cartridge of claim 1, wherein the propellant mechanism comprises a detonating primer.

10. The cartridge of claim 1, a regulator hole being further defined between the primary case and bullet cavities for regulating a velocity of the projectile upon firing.

11. The cartridge of claim 1, wherein the axial coupling involves the second end of the piston sleeve overlapping the primary case.

12. A two-piece, two-stage, reduced energy mechanically-operating cartridge for launching a projectile from a dedicated or modified firearm, comprising:

(a) a piston sleeve comprising a piston sleeve jacket defining a projectile cavity at a first longitudinal end for coupling the projectile therein, and a second end for coupling with a primary case, and the piston sleeve including one or more at least partially annular protrusion portions (hereinafter "cogs") or channels or both; and (b) the primary case comprising a primary case jacket for being axially coupled with the second end of the piston sleeve, and including one or more complementary cogs or channels, or both, to the one or more of the piston sleeve, and defining a primary case cavity for coupling with a propellant mechanism, and (c) a vent defined between the case and sleeve which opens to communicate with ambient air at a stage during dynamic action to relieve pressure within the primary case cavity an appropriate amount to achieve a sufficient balance;

(d) wherein said primary case and piston sleeve are configured such that an axial coupling of the primary case with the second end of the piston sleeve involves mating of the complementary cogs and channels of the primary case and piston sleeve, and (e) wherein at least one of the piston sleeve and the primary case includes an annular protrusion for stabilizing the coupling of the piston sleeve and the primary case, wherein upon activation, the piston sleeve and primary case telescope apart from the static position.

13. The cartridge of claim 12, wherein the jacket of the piston sleeve comprises a substantially non-deformable material, such that the piston sleeve jacket is reusable.

14. The cartridge of claim 13, wherein the jacket of the primary case also comprises a substantially non-deformable material, such that the primary case jacket is reusable.

15. The cartridge of claim 12, a regulator hole being further defined between the primary case and projectile cavities of selected size for regulating a velocity of the projectile upon activation.

16. The cartridge of claim 12, wherein the axial coupling involves the primary case overlapping the second end of the piston sleeve.

17. The cartridge of claim 12, wherein the annular protrusion comprises an O-ring.

18. The cartridge of claim 17, wherein the O-ring is disposed within an annular groove defined in the primary case.

19. The cartridge of claim 12, wherein said annular protrusion provides said axial stabilization of the coupling of the piston sleeve and primary case when said sleeve and case are coupled together in a static position.

20. A two-piece, two-stage, reduced energy mechanically-operating cartridge for launching a projectile from a dedicated or modified firearm, comprising:

(a) a piston sleeve comprising a piston sleeve jacket defining a projectile cavity at a first longitudinal end for coupling the projectile therein, and a primary case cavity defined at for coupling with a primary case;

(b) the primary case for being axially coupled with the second end of the piston sleeve, and defining a primary case cavity for coupling with a propellant mechanism;

(c) a regulator hole defined between the primary case and projectile cavities of the piston sleeve for regulating a velocity of the projectile upon firing;

(d) an annular protrusion for stabilizing the coupling of the piston sleeve and the primary case, wherein upon activation, the piston sleeve and primary case telescope apart from the static position, and (e) a vent defined between the case and sleeve which opens to communicate with ambient air at a stage during dynamic action to relieve pressure within the primary case cavity an appropriate amount to achieve a sufficient balance;

(f) wherein said primary case and piston sleeve are configured for axial coupling of the primary case with the second end of the piston sleeve, and (g) wherein said primary case and piston sleeve are further configured such that upon axial coupling, the piston sleeve and primary case become relatively axially movable to a fully compressed configuration, such that upon activation, the piston sleeve and primary case telescope from the static position in the opposite axial direction.

21. The cartridge of claim 20, wherein the annular protrusion comprises an O-ring.

22. The cartridge of claim 21, wherein the O-ring is disposed within an annular groove defined in the primary case.

23. The cartridge of claim 20, wherein the axial coupling involves the second end of the piston sleeve overlapping the primary case.

24. The cartridge of claim 20, wherein the jacket of the piston sleeve comprises a substantially non-deformable material, such that the piston sleeve jacket is reusable.

25. The cartridge of claim 24, wherein the jacket of the primary case also comprises a substantially non-deformable material, such that the primary case jacket is reusable.

26. The cartridge of claim 20, wherein said annular protrusion provides said axial stabilization of the coupling of the piston sleeve and primary case when said sleeve and case are coupled together in a static position.

27. A two-piece, two-stage, reduced energy mechanically-operating cartridge for launching a projectile from a dedicated or modified firearm, comprising:

(a) a piston sleeve comprising a piston sleeve jacket defining a projectile cavity at a first longitudinal end for coupling the projectile therein, and a second end for coupling with a primary case, and the piston sleeve; and (b) the primary case comprising a primary case jacket for being axially coupled with the second end of the piston sleeve, and defining a primary case cavity for coupling with a propellant mechanism, (c) wherein at least one of the piston sleeve and the primary case includes one or more partially annular protrusion portions (hereinafter "cogs") or channels or both, wherein the piston sleeve comprises two or more spaced apart cogs; and (d) wherein said primary case and piston sleeve are configured for axial coupling and compression together of the primary case with the second end of the piston sleeve; and (e) wherein said primary case and piston sleeve are further configured such that upon the axial coupling of the piston sleeve and primary case and at least partial compression together, the primary case and the piston sleeve become relatively rotationally movable, followed by relative axial movement to a fully compressed configuration, such that upon activation, when the piston sleeve and primary case telescope from the static position, the cogs or channels or both serve to prevent separation of the piston sleeve and primary case.

28. The cartridge of claim 27, wherein the primary case comprises complement portions for mating with the cogs of the piston sleeve and preventing said separation.

29. The cartridge of claim 28, wherein the cogs of the piston sleeve comprise three or more spaced-apart cogs.

30. The cartridge of claim 27, wherein the piston sleeve comprises a shoulder, such that upon activation when the piston sleeve and primary case are telescoping from the static position, said shoulder contacts a step between a chamber and a barrel of a firearm preventing the sleeve from advancing down the barrel, and instead the primary case thrusts rearward away from the barrel.

31. The cartridge of claim 27, wherein the jacket of the piston sleeve comprises a substantially non-deformable material, such that the piston sleeve jacket is reusable.

32. The cartridge of claim 31, wherein the jacket of the primary case also comprises a substantially non-deformable material, such that the primary case jacket is reusable.

* * * * *

UNITED STATES PATENT AND TRADEMARK OFFICE

CERTIFICATE OF CORRECTION

PATENT NO. : 7,621,208 B2
APPLICATION NO. : 11/616843
DATED : November 24, 2009
INVENTOR(S) : Rick Huffman It is certified that error appears in the above-identified patent and that said Letters Patent is hereby corrected as shown below:

Column 1, lines 26-29. Delete "due".

Column 1, line 43. Reads "maintain contact". should read "maintain<u>s</u> contact".

Column 4, line 20. There is a "." missing after "velocity" and before "The".

Column 13, line 7. "move" should be "move<u>s</u>".

Column 13, line 12. Claim reads "describes". This should read "describe<u>d</u>".

Column 13, lines 33-34. The spec reads "FIGS. 7F and 7g are the same as FIGS. 7a and 7b are included to shown that the case 2 and sleeve 4...". This should read "FIGS. 7F and 7g are the same as FIGS. 7a and 7b <u>and</u> are included to show~~n~~ that the case 2 and sleeve 4...".

Column 14, line 36. The spec reads "In the of this axial displacement, the sleeve...". This should read "In ~~the of~~ this axial displacement, the sleeve...".

Column 14, line 63. The spec reads "may be location where". This should read "may be <u>a</u> location where" or "may be locat<u>ed</u> where".

Column 16, claim 5, line 11. Claim reads "an step". This should read "<u>a</u> step".

Signed and Sealed this
Twenty-seventh Day of September, 2011

David J. Kappos

David J. Kappos
*Director of the United States Patent and Trademark Office*